US005091113A

United States Patent [19]

Clubley

[11] Patent Number: 5,091,113

[45] **Date of Patent: * Feb. 25, 1992**

[54] CORROSION INHIBITING COMPOSITION

[75] Inventor: Brian G. Clubley, Wilmslow, England

[73] Assignee: Ciba-Geigy Corporation, Ardsley, N.Y.

[ * ] Notice: The portion of the term of this patent subsequent to Sep. 25, 2007 has been disclaimed.

[21] Appl. No.: 558,926

[22] Filed: Jul. 27, 1990

Related U.S. Application Data

[62] Division of Ser. No. 191,090, May 6, 1988, Pat. No. 4,959,161.

[30] Foreign Application Priority Data

May 15, 1987 [GB] United Kingdom ..... 8711534

[51] Int. Cl.[5] ..... C23F 11/10; C07D 307/02

[52] U.S. Cl. ..... 252/396; 252/389.1; 252/389.62; 260/413; 562/582; 562/583; 562/503; 562/504; 562/508; 562/470; 422/17; 549/323

[58] Field of Search ..... 260/413; 262/582, 583, 262/503, 504, 508, 470; 252/389.1, 389.62, 396; 422/17; 549/323

[56] References Cited

U.S. PATENT DOCUMENTS 4,578,208 3/1986 Geke et al. ..... 252/135
4,959,161 9/1990 Clubley ..... 252/396

FOREIGN PATENT DOCUMENTS 0222311 11/1986 European Pat. Off. .

*Primary Examiner*—Robert L. Stoll
*Assistant Examiner*—Valerie D. Fee
*Attorney, Agent, or Firm*—Harry Falber

[57] ABSTRACT

II

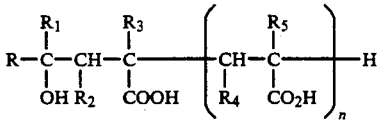

as well as salts or partial esters thereof wherein:

n is 0 or an integer ranging from 1 to 20,

R is a straight or branched chain $C_4$–$C_{30}$alkyl group, a straight or branched chain $C_4$–$C_{30}$alkyl group interrupted by one, two or three oxygen atoms or substituted by one, two or three hydroxy groups, a $C_5$–$C_{12}$cycloalkyl group, a $C_6$–$C_{10}$aryl group, $C_6$–$C_{10}$aryl group substituted by one, two or three $C_1$–$C_{12}$alkyl groups, a $C_7$–$C_{13}$aralkyl group or a $C_7$–$C_{13}$aralkyl group which is substituted by a hydroxyl group;

$R_1$ is H or a straight- or branched chain $C_1$–$C_4$alkyl group;

$R_2$ is H, a straight or branched chain $C_1$–$C_4$alkyl group or $CO_2H$;

$R_3$ is H, a straight or branched chain $C_1$–$C_4$alkyl group, $—CH_2CO_2H$ or $—CH_2CH_2CO_2H$;

$R_4$ is H, a straight or branched chain $C_1$–$C_4$alkyl or $CO_2H$;

$R_5$ is H, a straight or branched chain $C_1$–$C_4$alkyl group, $CH_2CO_2H$ or $CH_2CH_2CO_2H$; with the following proviso when n is an integer from 1 to 20 at least one group $R_4$ is $CO_2H$.

11 Claims, No Drawings

CORROSION INHIBITING COMPOSITION

This is a divisional of application Ser. No. 191,090, filed on May 6, 1988, now U.S. Pat. No. 4,959,161, issued on Sept. 25, 1990.

The present invention relates to corrosion inhibiting compositions.

Many compounds or formulations are known to inhibit the corrosion of ferrous metals in contact with aqueous or partially aqueous systems. Traditionally, such corrosion inhibitors contain metals such as chromium or zinc, phosphorus in the form of phosphate, polyphosphate or phosphonate, or sodium nitrite. Most of these known corrosion inhibitors are now believed to have an adverse effect on the environment when they are discharged into water systems. The known corrosion inhibitors can cause environmental damage due to their toxicity or to their tendency to promote biological growth.

Many carboxylic acid derivatives have been examined as alternative corrosion inhibitors. Generally however, high additive levels are required if carboxylic acid derivatives are to provide acceptable corrosion-inhibiting performance.

Polymeric carboxylic acids have also been described as corrosion inhibitors but again, high levels of additive are normally required.

From the GB-PS 1 037 985 a group of alkylbutyrolactone-α-acetic acids became known as rust inhibitors in lubricating oil compositions.

Surprisingly we have found that certain hydroxy carboxylic acid derivatives which may be monomeric, polymeric or mixtures of these, are particularly effective for inhibiting corrosion of ferrous metals at low addition levels.

Accordingly the present invention provides a composition, in contact with a corrodable metal surface, preferably a ferrous metal surface, which composition comprises a) an aqueous-based or oil-based system; and b) an effective amount of, as inhibitor for protecting the metal surface against corrosion, at least one compound having the formula I:

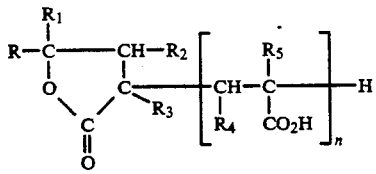

I as well as salts or partial esters thereof wherein:

n is 0 or an integer ranging from 1 to 20, n preferably being an integer of from 1 to 10, more preferably an integer of from 1 to 5;

R is a straight or branched chain $C_4$–$C_{30}$alkyl group, optionally interrupted by one, two or three oxygen atoms or substituted by one, two or three hydroxy groups, a $C_5$–$C_{12}$cycloalkyl group, a $C_6$–$C_{10}$aryl group optionally substituted by one, two or three $C_1$–$C_{12}$alkyl groups, or a $C_7$–$C_{13}$aralkyl group which is optionally substituted by a hydroxyl group;

$R_1$ is H or a straight- or branched chain $C_1$–$C_4$alkyl group;

$R_2$ is H, a straight or branched chain $C_1$–$C_4$alkyl group or $CO_2H$;

$R_3$ is H, a straight or branched chain $C_1$–$C_4$alkyl group, —$CH_2CO_2H$ or —$CH_2CH_2CO_2H$;

$R_4$ is H, a straight or branched chain $C_1$–$C_4$alkyl group or $CO_2H$;

$R_5$ is H, a straight or branched chain $C_1$–$C_4$alkyl group, $CH_2CO_2H$ or $CH_2CH_2CO_2H$; provided that at least one group $R_4$ must be $CO_2H$, with the proviso, that compositions comprising an oil-based system and a compound having the formula

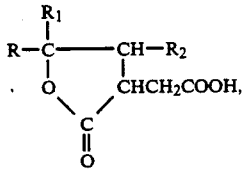

wherein R, $R_1$ and $R_2$ are hydrogen or alkyl radicals, having a total from 10 to 38 C-atoms, are excluded.

When more than one compound of formula I is present such mixtures of compounds of formula I may derive from variations in the nature of one or more of the substituents R, $R_1$, $R_2$, $R_3$, $R_4$ and $R_5$ e.g. a mixture of one compound of formula I in which R is $C_8$–$C_{10}$alkyl.

When the compound of the formula I is present in the form of a salt, due to the opening of the lactone ring in basic media, such salts may have the formula II:

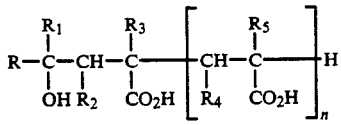

II where R, $R_1$, $R_2$, $R_3$, $R_4$, $R_5$ and n are as previously defined but where some or all of the $CO_2H$ groups are present as $CO_2M$ groups wherein M is an alkali metal, ammonium, amine or hydroxy-amine group.

By the term "partial esters" of a compound of formula I, we mean that some, but not all of the $CO_2H$ groups in the compound of formula I are esterified to groups of formula —$CO_2Z$ in which Z is $C_1$–$C_4$alkyl optionally interrupted by one O-atom, $C_7$–$C_9$phenylalkyl, $C_7$–$C_{18}$-alkylphenyl or $C_6$–$C_{10}$aryl. When more than one —$CO_2Z$ group is present, the individual groups Z may be the same or different.

Salts of compounds of formula I are metal-, ammonium-, or amine salts, especially salts of alkali metals, alkaline earth metals, metals of groups IIB, IIIA or VIII of the Periodic System of Elements, ammonium salts or salts of organic amines. Specific examples are sodium, potassium, calcium, magnesium, zinc, aluminium, ammonium, tri-($C_1$–$C_4$)alklyammonium, bis- and tris(hydroxyethyl)ammonium, octylamine and dodecylamine salts.

When R is a straight or branched $C_4$–$C_{30}$alkyl group, R may be e.g. a straight or branched chain butyl, pentyl, hexyl, heptyl, octyl, nonyl, decyl, undecyl, dodecyl, tridecyl, tetradecyl, pentadecyl, eicosyl or triacontyl preferably a straight chain $C_4$–$C_{20}$, especially $C_6$–$C_{15}$alkyl residue.

When R is a straight or branched $C_4$–$C_{30}$alkyl group optionally interrupted by from one to three oxygen atoms, it may be e.g. a residue having the formula $C_3H_7OCH_2$, $C_4H_9OCH_2$, $C_5H_{11}OCH_2$, $C_6H_{13}OCH_2$, $C_7H_{15}OCH_2$, $C_8H_{17}OCH_2$, $C_9H_{19}OCH_2$, $C_{10}H_{21}OCH_2$, $C_{11}H_{23}OCH_2$, $C_{14}H_{29}OCH_2$ or $C_{29}H_{59}OCH_2$;

$CH_3OCH_2CH_2OCH_2$, $C_2H_5OCH_2CH_2OCH_2$, $C_3H_7OCH_2CH_2OCH_2$, $C_4H_9OCH_2CH_2OCH_2$, $C_5H_{11}OCH_2CH_2OCH_2$, $C_6H_{13}OCH_2CH_2OCH_2$, $C_7H_{15}OCH_2CH_2OCH_2$, $C_8H_{17}OCH_2CH_2OCH_2$, $C_9H_{19}OCH_2CH_2OCH_2$, $C_{10}H_{21}OCH_2CH_2OCH_2$, $C_{27}H_{55}OCH_2CH_2OCH_2$, $CH_3OCH_2CH_2OCH_2CH_2OCH_2$, $C_2H_5OCH_2CH_2OCH_2CH_2OCH_2$, $C_3H_7OCH_2CH_2OCH_2CH_2OCH_2$, $C_4H_9OCH_2CH_2OCH_2CH_2OCH_2$, $C_5H_{11}OCH_2CH_2OCH_2CH_2OCH_2$, $C_{10}H_{21}OCH_2CH_2OCH_2CH_2OCH_2$, $C_{25}H_{51}OCH_2CH_2OCH_2CH_2OCH_2$, $C_2H_5OCH_2CH_2$, $C_3H_7OCH_2CH_2$, $C_4H_9OCH_2CH_2$, $C_5H_{11}OCH_2CH_2$, $C_6H_{13}OCH_2CH_2$, $C_7H_{15}OCH_2CH_2$, $C_8H_{17}OCH_2CH_2$, $C_{10}H_{21}OCH_2CH_2$, $C_{28}H_{57}OCH_2CH_2$.

When R is straight or branched chain $C_4$–$C_{30}$alkyl substituted by one, two or three hydroxyl groups, it may be e.g. a residue having the formula $HO(CH_2)_4$, $HO(CH_2)_5$, $HO(CH_2)_6$, $HO(CH_2)_7$, $HO(CH_2)_8$, $HO(CH_2)_9$ or $HO(CH_2)_{30}$;

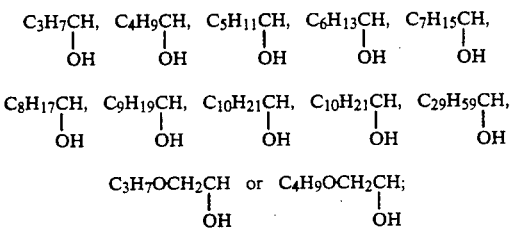

$C_5$–$C_{12}$cycloalkyl groups R include, for instance, cyclopentyl, cyclohexyl, cyclooctyl and cyclododecyl.

$C_6$–$C_{10}$aryl groups R optionally substituted by 1 to 3 $C_1$–$C_{12}$alkyl groups include, e.g. phenyl, naphthyl, tolyl, xylyl, p-dodecylphenyl and 1-octylnaphthyl groups, preferred is phenyl.

$C_7$–$C_{13}$aralkyl groups R include benzyl, naphthylmethyl and 4-hydroxybenzyl groups, preferred is benzyl.

Examples of $R_1$ are, by way of illustration, H, methyl, ethyl, isopropyl and n-butyl.

Examples of M are, for instance, sodium, potassium, ammonium, diethanolamine, triethanolamine, octylamine and dodecylamine.

When the group Z is a $C_1$–$C_4$ straight or branched chain alkyl group it may be, for example, a methyl, ethyl, n-propyl, iso-propyl, n-butyl, s-butyl or t-butyl group.

When the group Z is a $C_1$–$C_4$alkyl group optionally interrupted by one or more O atoms it may be, for example, 2-methoxy-ethyl, 3-methoxy-propyl or 2-ethoxy-ethyl.

When the group Z is a $C_7$–$C_9$phenylalkyl group it may, for example, benzyl, 1-phenylethyl, 2-phenylethyl, α,α-dimethylbenzyl or 3-phenylpropyl.

When the group Z is a $C_7$–$C_{18}$alkylphenyl group it may be, for example, tolyl, xylyl, 4-isopropylphenyl, 4-t-butylphenyl, 4-octylphenyl or 4-dodecylphenyl.

When the group Z is unsubstituted or substituted $C_6$–$C_{10}$aryl, it may be e.g. phenyl, 1-naphthyl or 2-naphthyl.

Preferred compounds of formula I are those wherein R is $C_4$–$C_{20}$alkyl, more preferably $C_6$–$C_{15}$alkyl and is of straight chain optionally interrupted by one or two oxygen atoms; $R_1$ is H; $R_2$ is $CO_2H$; $R_3$ is H; $R_4$ is $CO_2H$; and $R_5$ is H.

Preferably n is an integer of from 1 to 10 and more preferably an integer of from 1 to 5.

From formulae I and II it is apparent that compounds of the invention may be monomeric (where n is 0) or polymeric or mixtures of both. It is a feature of the present invention that mixed products are preferred that is products in which both compound types are present viz. products in which n is 0 mixed with those in which n is 1–20.

Compounds of formula I may be prepared by reaction of an alcohol of formula III

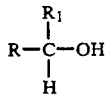

III wherein R and $R_1$ have their previous significance, with a) at least one unsaturated compound of formula IV

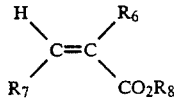

IV wherein $R_6$ is H, a $C_1$–$C_4$alkyl group, $CO_2H$ or a $CO_2R_9$ group;

$R_7$ is H, a $C_1$–$C_4$alkyl group, $CO_2H$, $CO_2R_9$, $CH_2CO_2H$, $CH_2CO_2R_9$, $CH_2CH_2CO_2H$ or $CH_2CH_2CO_2R_9$;

$R_8$ is H or $C_1$–$C_4$alkyl, and $R_9$ is $C_1$–$C_4$alkyl or with b) an anhydride of formula V or VI:

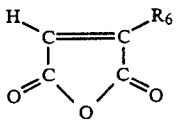

V or

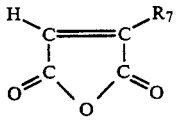

VI wherein $R_6$ and $R_7$ have their previous significance.

Preferably, $R_6$ is H, $R_7$ is $CO_2CH_3$, $R_8$ is $CH_3$ and $R_9$ is $CH_3$.

Examples of alcohols of formula III include: butanol, pentanol, hexanol, octanol, nonanol, decanol, dodecanol, tridecanol, tetradecanol, pentadecanol, octadecanol, eicosanol, docosanol, triacontanol. Preferred alcohols of formula III are those having from 5 to 15 carbon atoms.

Examples of unsaturated compounds of formula IV, V or VI include: acrylic acid, methyl acrylate, ethyl acrylate, maleic acid, maleic anhydride, dimethyl maleate, diethyl maleate, itaconic acid, itaconic anhydride, dimethyl itaconate, diethyl itaconate, citraconic acid, citraconic anhydride, dimethyl citraconate, diethyl citraconate, aconitic acid, aconitic anhydride, dimethyl aconitate and diethyl aconitate.

The reaction is conveniently carried out in the presence of a free radical catalyst at elevated temperature, for example in the presence of benzoyl peroxide or di-tertiary butyl peroxide, preferably di-tertiary butyl peroxide. The temperature may be in the range of 50°-200° C., preferably 100°-180° C. An inert solvent or diluent may be added but the reaction is preferably performed without solvent.

Esters formed as intermediates are hydrolysed by treatment with acid or base at elevated temperatures. For example esters may be hydrolysed by refluxing with hydrochloric acid to give products in the acid form having formula I, or by refluxing with sodium hydroxide to give products as sodium salts having formula II.

The above reaction produces mixtures of monomeric product (where n is 0) and polymeric acid. The ratio of monomer to polymer can be altered by varying the stoichiometry of the reaction. For example, increasing the amount of alcohol employed in the reaction imparts an increased monomer content to the mixture. Pure monomer can isolated from the reaction mixture, if required.

Alternative catalysts which may be employed for the reaction, include for example $\gamma$-irradiation or ultra-violet light.

Pure lactone monomers may be prepared e.g. by reaction of the appropriate aldehydes with succinic acid or esters (Stobbe condensation); or reaction of the appropriate aldehydes with bromosuccinic esters (Reformatsky reaction); or reaction of the corresponding epoxides or epoxy esters with malonic esters.

Any amount of the compound of formula I, or mixture thereof, which is effective as a corrosion inhibitor in the composition according to the invention can be used, but the amount preferably ranges from 0.0001 to 5% by weight, based on the total weight of the aqueous- or oil-based system.

The substrate base for the compositions of the present invention is either a) an aqueous-based system or b) an oil-based system. The substrate base is preferably an aqueous-based system.

Examples of systems which may provide the base for the compositions according to the present invention include functional fluids such as lubricants e.g. those having a mineral oil, poly-alpha olefin or synthetic carboxylic acid ester base; hydraulic fluids e.g. those based on mineral oils, phosphate esters, aqueous polyglycol/polyglycol ether mixtures or glycol systems; oil-in-water or water-in-oil systems; metal-working fluids having, as their base, mineral oil for aqueous systems; water- or aqueous glycol- or ethylene- or propylene glycol/methanol based engine coolant systems; transformer- or switch oils; as well as aqueous systems e.g. industrial cooling water; aqueous air-conditioning systems; steam-generating systems; sea-water evaporator systems; hydrostatic cookers; and aqueous closed circuit heating or refrigerant systems.

When a functional fluid system is a synthetic lubricant, examples thereof include lubricants based on a diester of a dibasic acid and a monohydric alcohol, for instance dioctyl sebacate or dinonyladipate; on a triester of trimethylolpropane and a monobasic acid or mixture of such acids, for instance trimethylol propane tripelargonate, trimethylolpropane tricaprylate or mixtures thereof; on a tetraester of pentaerythritol and a monobasic acid or mixture of such acids, for instance pentaerythritol tetracaprylate; or on complex esters derived from monobasic acids, dibasic acids and polyhydric alcohols, for instance a complex ester derived from trimethylol propane, caprylic acid and sebacic acid; or of mixtures thereof.

Other synthetic lubricants are those known to the art-skilled and described e.g. in "Schmiermittel-Taschenbuch" (Huethig Verlag, Heidelberg 1974). Especially suitable, apart from the preferred mineral oils are e.g. phosphates, glycols, polyglycols, polyalkylene glycols and poly-alpha olefins.

In order to improve varicus applicational properties, a functional fluid composition of the invention may also contain other additives such as, for oil-based systems, one or more of antioxidants, metal deactivators, further corrosion or rust inhibitors, viscosity-index improvers, pourpoint depressants, dispersants/surfactants or anti-wear additives; and for aqueous-based systems, one or more of antioxidants, other corrosion- and rust inhibitors, metal deactivators, extreme pressure- or anti-wear additives, complexing agents, precipitation inhibitors, biocides, buffering agents and anti-foams.

For oil-based systems, examples of other additives are:

EXAMPLES OF PHENOLIC ANTIOXIDANTS

1. Alkylated Monophenols 2,6-Di-tert.-butylphenol
2-tert.-butyl-4,6-dimethylphenol
2,6-di-tert.-butyl-4-ethylphenol
2,6-di-tert.-butyl-4-n-butylphenol
2,6-di-tert.-butyl-4-i-butylphenol
2,6-di-cyclcopentyl-4-methylphenol
2-($\beta$-methylcyclohexyl)-4,6-dimethylphenol
2,6-di-octadecyl-4-methylphenol
2,4,6-tri-cyclohexylphenol
2,6-di-tert.-butyl-4-methoxymethylphenol

2. Alkylated Hydroquinones 2,6-Di-tert.-butyl-4-methoxyphenol
2,5-di-tert.-butyl-hydroquinone
2,5-di-tert-amyl-hydroquinone
2,6-diphenyl-4-octadecyloxyphenol

3. Hydroxylated Thiodiphenylethers 2,2'-Thio-bis-(6-tert.-butyl-4-methylphenol)
2,2'-thio-bis-(4-octylphenol)
4,4'-thio-bis-(6-tert.-butyl-3-methylphenol)
4,4'-thio-bis-(6-tert.-butyl-2-methylphenol)

4. Alkylidene-Bisphenols 2,2'-Methylene-bis-(6-tert.-butyl-4-methylphenol)
2,2'-methylene-bis-(6-tert.-butyl-4-ethylphenol)
2,2'-methylene-bis-(4-methyl-6-($\alpha$-methylcyclohexyl)-phenol)
2,2'-methylene-bis-(4-methyl-6-cyclohexylphenol)
2,2'-methylene-bis-(6-nonyl-4-methylphenol)
2,2'-methylene-bis-(4,6-di-tert.-butylphenol)
2,2'-ethylidene-bis-(4,6-di-tert.-butylphenol)
2,2'-ethylidene-bis-(6-tert.-butyl-4-isobutylphenol)
2,2'-methylene-bis-(6-($\alpha$-methylbenzyl-4-nonylphenol)
2,2'-methylene-bis-(6-($\alpha$,$\alpha$-dimethylbenzyl)-4-nonylphenol)
4,4'-methylene-bis-(6-tert.-butyl-2-methylphenol)
1,1'-bis-(5-tert.-butyl-4-hydroxy-2-methylphenol)-butane 2,6-di-(3-tert.-butyl-5-methyl-2-hydroxybenzyl)-4-methylphenol 1,1,3-tris-(5-tert.-butyl-4-hydroxy-2-methylphenyl)-3-n-dodecyl)-mercaptobutane ethyleneglycol-bis-[3,3-bis-(3'-tert.-butyl-4'-hydroxyphenyl)-butyrate]

di-(3-tert.-butyl-4-hydroxy-5-methylphenyl)-dicyclopentadiene di-[3'-tert.-butyl-2'-hydroxy-5'-methyl-benzyl)-6-tert.-butyl-4-methylphenyl]-terephthalate 5. Benzyl Compounds 1,3,5-Tri-(3,5-di-tert.-butyl-4-hydroxybenzyl)-2,4,6-trimethyl-benzene di-(3,5-di-tert.-butyl-4-hydroxybenzyl)-sulfide bis-(4-tert.-butyl-3-hydroxy-2,6-dimethylbenzyl)dithiol-terephthalate 1,3,5-tris-(3,5-di-tert.-butyl-4-hydroxybenzyl)-isocyanurate 1,3,5-tris-(4-tert.-butyl-3-hydroxy-2,6-dimethylbenzyl)-isocyanurate 3,5-di-tert.-butyl-4-hydroxybenzyl-phosphonic acid-dioctadecylester 3,5-di-tert.-butyl-4-hydroxybenzyl-phosphonic acid-monoethylester,
calcium-salt 6. Acylaminophenols 4-Hydroxy-lauric acid anilide 4-hydroxy-stearic acid anilide 2,4-bis-octylmercapto-6-(3,5-di-tert.-butyl-4-hydroxyanilino)-s-triazine N-(3,5-di-tert.-butyl-4-hydroxyphenyl)-carbamic acid octyl ester 7. Esters of
β-(3,5-Di-tert.-butyl-4-hydroxyphenol)-propionic acid
with mono- or polyhydric alcohols e.g. with

| | |
|---|---|
| methanol | diethyleneglycol |
| octadecanol | triethyleneglycol |
| 1,6-hexanediol | pentaerythritol |
| neopentylglycol | tris-hydroxyethyl-isocyanurate |
| thiodiethyleneglycol | bis-hydroxyethyl-oxalic acid diamide |

8. Esters of
β-(5-tert.-butyl-4-hydroxy-3-methylphenyl)-propionic acid
with mono- or polyhydric alcohols e.g. with

| | |
|---|---|
| methanol | diethyleneglycol |
| octadecanol | triethyleneglycol |
| 1,6-hexanediol | pentaerythritol |
| neopentylglycol | tris-hydroxyethyl-isocyanurate |
| thiodiethyleneglycol | di-hydroxyethyl-oxalic acid diamide |

9. Amides of
β-(3,5-Di-tert.-butyl-4-hydroxyphenyl)-propionic acid
e.g.

N,N'-Di-(3,5-di-tert.-butyl-4-hydroxyphenylpropionyl)-hexamethylenediamine

N,N'-di-(3,5-di-tert.-butyl-4-hydroxyphenylpropionyl)-trimethylenediamine

N,N'-di-(3,5-di-tert.-butyl-4-hydroxyphenylpropionyl)-hydrazine

EXAMPLES OF AMINE ANTIOXIDANTS

N,N'-Di-isopropyl-p-phenylenediamine

N,N'-di-sec.-butyl-p-phenylenediamine

N,N'-bis(1,4-dimethyl-pentyl)-p-phenylenediamine

N,N'-bis(1-ethyl-3-methyl-pentyl)-p-phenylenediamine

N,N'-bis(1-methyl-heptyl)-p-phenylenediamine

N,N'-bis(1-methyl-heptyl)-p-phenylenediamine

N,N'-dicyclohexyl-p-phenylenediamine

N,N'-diphenyl-p-phenylenediamine

N,N'-di-(naphthyl-2-)-p-phenylenediamine

N-isopropyl-N'-phenyl-p-phenylenediamine

N-(1,3-dimethyl-butyl)-N'-phenyl-p-phenylenediamine

N-(1-methyl-heptyl)-N'-phenyl-p-phenylenediamine

N-cyclohexyl-N'-phenyl-p-phenylenediamine 4-(p-toluene-sulfonamido)-diphenylamine N,N'-dimethyl-N,N'-di-sec.-butyl-p-phenylenediamine diphenylamine 4-isopropoxy-diphenylamine N-phenyl-1-naphthylamine N-phenyl-2-naphthylamine octylated diphenylamine octylated N-phenyl-α(or)β-naphthylamine 4-n-butylaminophenol 4-butyrylamino-phenol 4-nonanoylamino-phenol 4-dodecanoylamino-phenol 4-isodecanoylamino-phenol 4-octadecanoylamino-phenol di-(4-methoxy-phenyl)-amine 2,6-di-tert.-butyl-4-dimethylamino-methyl-phenol 2,4'-diamino-diphenylmethane 4,4'-diamino-diphenylmethane N,N,N',N'-tetramethyl-4,4'-diamino-diphenylmethane 1,2-di-(phenylamino)-ethane 1,2-di-[2-methyl-phenyl)-amino]-ethane 1,3-di-(phenylamino)-propane (o-tolyl)-biguanide di-[4-(1',3'-dimethyl-butyl)-phenyl]amine

EXAMPLES OF FURTHER METAL PASSIVATORS ARE for copper e.g. Benzotriazole, tolutirazole and derivatives thereof, tetrahydrobenzotriazole, 2-mercaptobenzothiazole, 2,5-dimercaptothiadiazole, salicylidene-propylenediamine and salts of salicylaminoguanidine.

EXAMPLES OF RUST INHIBITORS ARE a) Organic acids, their esters, metal salts and anhydrides, e.g. N-oleoyl-sarcosine, sorbitan-mono-oleate, lead-naphthenate, dodecenylsuccinic acid (and its partial esters and amides), 4-nonyl-phenoxy-acetic acid.

b) Nitrogen-containing compounds e.g.

I. Primary, secondary or tertiary aliphatic or cycloaliphatic amines and amine-salts of organic and inorganic acids, e.g. oil-soluble alkylammonium carboxylates II. Heterocyclic compounds e.g. substituted imidazolines and oxazolines c) Phosphorus-containing compounds e.g.

Amine salts of phosphonic acid or acid partial esters, zinc dialkyldithio phosphates d) Sulfur-containing compounds e.g.

Barium-dinonylnaphthalene-n-sulfonates, calcium petroleum sulfonates

EXAMPLES OF VISCOSITY-INDEX IMPROVERS ARE E.G.

Polymethacrylates, vinylpyrrolidone/methacrylate-copolymers, polybutenes, olefin-copolymers styrene/acrylate-copolymers.

EXAMPLES OF POUR-POINT DEPRESSANTS ARE E.G.

Polymethacrylates, or alkylated naphthalene derivatives

EXAMPLES OF DISPERSANTS/SURFACTANTS ARE E.G.

Polybutenylsuccinic acid-amides, polybutenylphosphonic acid derivatives, basic magnesium-, calcium-, and bariumsulfonates and -phenolates.

EXAMPLES OF ANTI-WEAR ADDITIVES ARE E.G.

Sulfur- and/or phosphorus- and/or halogen-containing compounds e.g. sulfurised vegetable oils, zinc dialkyldithiophosphates, tritolylphosphate, chlorinated paraffins, alkyl- and aryldisulfides.

In the treatment of substrates which are completely aqueous, such as cooling water systems, air-conditioning systems, steam-generating systems, sea-water evaporator systems, hydrostatic cookers, and closed circuit heating or refrigerant systems, further corrosion inhibitors may be used such as, for example, water soluble zinc salts; phosphates; polyphosphates; phosphonic acids and their salts, for example, hydroxyethyldiphosphonic acid (HEDP), nitrilotris methylene phosphonic acid and methylamino dimethylene phosphonocarboxylic acids and their salts, for example, those described in German Offenlegungsschrift 2632774, hydroxyphosphonoacetic acid, 2-phosphonobutane-1,2,4-tricarboxylic acid and those disclosed in GB 1572406; nitrates, for example sodium nitrate; nitrites e.g. sodium nitrite; molybdates e.g. sodium molybdate; tungstates, silicates e.g. sodium silicate; benzotriazole, bis-benzotriazole or copper deactivating benzotriazole or tolutriazole derivatives or their Mannich base derivatives; mercaptobenzothiazole; N-acyl sarcosines; N-acylimino diacetic acids; ethanolamines; fatty amines; and polycarboxylic acids, for example, polymaleic acid and polyacrylic acid, as well as their respective alkali metal salts, copolymers of maleic anhydride, e.g. copolymers of maleic anhydride and sulfonated styrene, copolymers or acrylic acid e.g. copolymers or acrylic acid and hydroxyalkylated acrylic acid, and substituted derivatives of polymaleic and polyacrylic acids and their copolymers. Moreover, in such completely aqueous systems, the corrosion inhibitor according to the invention may be used in conjunction with dispersing and/or threshold agents e.g. polymerised acrylic acid (or its salts), phosphinopolycarboxylic acids (as described and claimed in British Patent 1458235), the cotelomeric compounds described in European Patent Application No. 0150706, hydrolysed polyacrylonitrile, polymerised methacrylic acid and its salts, polyacrylamide and co-polymers thereof from acrylic and methacrylic acids, lignin sulphonic acid and its salts, tannin, naphthalene sulphonic acid/formaldehyde condensation products, starch and its derivatives, cellulose, acrylic acid/lower alkyl hydroxyacrylate copolymers e.g. those described in U.S. Pat. No. 4,374,733 and combinations thereof. Specific threshold agents, such as for example, 2-phosphonobutane-1,2,4-tricarboxylic acid (PBSAM), hydroxyethyldiphosphonic acid (HEDP), hydrolysed polymaleic anhydride and its salts, alkyl phosphonic acid, hydroxyphosphonoacetic acid, 1-aminoalkyl-1,1-diphosphonic acids and their salts, and alkali metal poly-phosphates, may also be used.

Particularly interesting additive packages are those comprising compounds of formula I with one or more of polymaleic acid or polyacrylic acid or their copolymers, and/or HEDP and/or PBSAM and/or triazoles e.g. tolutriazole.

Precipitating agents such as alkali metal orthophosphates, carbonates; oxygen scavengers such as alkali metal sulphites and hydrazines; sequestering agents such as nitrilotriacetic acid and its salts; anti-foaming agents such as silicones e.g. poly-dimethylsiloxanes, distearylsebacamides, distearyl adipamide and related products derived from ethylene oxide and/or propylene oxide condensations, in addition to fatty alcohols, such as capryl alcohols and their ethylene oxide condensates; and biocides e.g. amines, quaternary ammonium compounds, chlorophenols, sulphur-containing compounds such as sulphones, methylene bis thiocyanates and carbamates, isothiazolones, brominated propionamides, triazines, phosphonium compounds, chlorine and chlorine-release agents and organometallic compounds such as tributyl tin oxide, may be used.

The functional fluid system may be partly aqueous e.g. an aqueous machining fluid formulation, e.g. a water dilutable cutting or grinding fluid.

The aqueous machining fluid formulations according to the invention may be e.g. metal working formulations. By "metal working" we mean reaming, broaching, drawing, spinning, cutting, grinding, boring, milling, turning, sawing, non-cutting shaping, rolling or quenching. Examples of water-dilutable cutting or grinding fluids into which the corrosions inhibiting compound may be incorporated include:

a) Aqueous concentrates of one or more corrosions inhibitors, and optionally one or more anti-water additives which are usually employed as grinding fluids;

b) Polyglycols containing biocides, corrosion inhibitors and anti-wear additives for cutting operations or grinding;

c) Semi-synthetic cutting fluids similar to (b) but containing in addition 10 to 25% oil with sufficient emulsifier to render the water diluted product translucent;

d) An emulsifiable mineral oil concentrate containing, for example, emulsifiers, corrosion inhibitors, extreme pressure/anti-wear additives, biocides, antifoaming agents, coupling agents etc; they are generally diluted with water to a white opaque emulsion;

e) A product similar to (d) containing less oil and more emulsifier which on dilution gives a translucent emulsion for cutting or grinding operations.

For those partly-aqueous systems in which the functional fluid is an aqueous machining fluid formulation the inhibitor component B) may be used singly, or in admixture with other additives e.g. known further corrosion inhibitors or extreme-pressure additives.

Examples of other corrosion inhibitors which may be used in these partly aqueous systems, in addition to the compound of formula I used according to the invention, include the following groups:

a) Organic acids, their esters or ammonium, amine, alkanolamine and metal salts, for example, benzoic acid, p-tert.-butyl benzoic acid, disodium sebacate, triethanolamine laurate, iso-nonanoic acid, triethanolamine salt of p-toluene sulphonamide caproic acid, triethanolamine salt of benzene sulphonamide caproic acid, triethanolamine salts of 5-ketocarboxylic acid derivatives as described in European Patent No. 41927, sodium N-lauroyl sarcosinate or nonyl phenoxy acetic acid;

b) Nitrogen containing materials such as the following types: fatty acid alkanolamides; imidazolines, for example, 1-hydroxy-ethyl-2-oleyl-imidazolines; oxazolines; triazoles for example, benzotriazoles; or their Mannich base derivatives; triethanolamines; fatty amines, inorganic salts, for example, sodium nitrate; and the carboxy-triazine compounds described in European Patent No. 46139;

c) Phosphorus containing materials such as the following types: amine phosphates, phosphonic acids or inorganic salts, for example, sodium dihydrogen phosphate or zinc phosphate;

d) Sulphur containing compounds such as the following types: sodium, calcium or barium petroleum sulphonates, or heterocyclics, for example, sodium mercaptobenzothiazole. Nitrogen containing materials, particularly triethanolamine, are preferred.

The following Examples further illustrate the present invention.

EXAMPLE 1

257.2 parts of n-decanol are heated with stirring to 150° C. and a mixture of 78 parts of dimethyl maleate and 13.5 parts of di-t-butyl peroxide added dropwise over 6 hours at 140°-150° C. The mixture is then heated for a further 3 hours at 140°-150° C. Excess starting materials are removed by distillation up to 150° C. under a vacuum of 22.5 mbar. Intermediate lactone ester is then distilled at 158°-162° C. under a vacuum of 0.4 mbar to give 63.0 parts of colourless liquid product which solidifies on standing.

50.2 parts of the above ester, 14.9 parts of sodium hydroxide and 500 parts of water are mixed and stirred at reflux for 12 hours. The mixture is cooled and extracted with ether to remove unreacted starting material. 568.0 parts of pale yellow aqueous solution remain, containing 9% by weight of hydroxy di-acid product as sodium salt. Structure is confirmed by infra-red, H', and $C^{13}$ NMR analysis.

EXAMPLE 2

217.4 parts of aqueous solution from Example 1 containing 9% by weight of product are acidified to pH 1 by addition, with stirring, of concentrated hydrochloric acid. The resulting white solid is filtered off, washed with water and dried to yield 41.9 parts of crude product. Recrystallisation from petroleum ether/toluene yields 35.0 parts of lactone acid product, melting point 83°-84° C.

Theory % C=65.63, % H=9.38
Found % C=66.19, % H=9.37.

EXAMPLE 3

142.2 parts of n-decanol are heated with stirring to 150° C. and a mixture of 43.2 parts of dimethyl maleate and 7.5 parts of di-t-butyl peroxide added dropwise over 6 hours at 140°-150° C. The mixture is then heated for a further 3 hours at 140°-150° C. Excess starting materials are removed by distillation up to 150° C. under vacuum of 22.5 mbars to yield 64.0 parts of ester intermediate comprising a mixture of monomer and polymer.

32.0 parts of the above ester mixture are added to a solution of 9.5 parts of sodium hydroxide in 250 parts of water. The mixture is stirred at reflux for 13 hours, cooled and extracted with ether to remove unreacted starting material. 289.0 parts of yellow aqueous solution remain, containing 11% by weight of product as sodium salt. Structure is confirmed by infra red, H' and $C^{13}$ NMR analysis.

G.P.C. analysis indicated a ratio of approximately 1:1 monomer:polymer in the mixture.

EXAMPLE 4

237.0 parts of n-decanol are heated with stirring to 150° C. and a mixture of 43.2 parts of dimethyl maleate and 7.5 parts of di-t-butyl peroxide added dropwise over 6 hours at 140°-150° C. The mixture is then heated for a further 3 hours at 140°-150° C. Excess starting materials are removed by distillation up to 135° C. under vacuum of 0.026 mbar to yield 71.0 parts of mixed ester intermediate. 500 parts of 18% hydrochloric acid are added and the mixture stirred at reflux for 16 hours. The mixture is cooled and evaporated to dryness on a rotary evaporator under water pump vacuum to yield 62.0 parts of yellow, waxy solid product. I.R. and NMR analysis confirm the product to be a mixture of monomeric lactone acid and poly acid.

EXAMPLE 5

585.0 parts of n-octanol are heated with stirring to 150° C. and a mixture of 129.6 parts of dimethyl maleate and 22.1 parts di-t-butyl peroxide added dropwise over 6 hours at 140°-150° C. The mixture is then heated for a further 3 hours at 141° C. Excess starting materials are removed by distillation up to 85° C. under vacuum of 0.4 mbar. Intermediate lactone ester is then distilled at 90° C. under a vacuum of 0.023 mbar to give 295.5 parts of colourless liquid product.

50.0 parts of the above ester are mixed with a solution of 16.5 parts of sodium hydroxide in 400 parts of water and the mixture stirred at reflux for 13 hours. The mixture is cooled and extracted with ether to remove unreacted starting material. 420.0 parts of pale yellow liquid product remain containing 12.4% by weight of hydroxy di-acid product as sodium salt. Structure is confirmed by I.R. and NMR analysis.

EXAMPLE 6

200.0 parts of intermediate lactone ester from Example 5 are mixed with 1600 parts of 18% hydrochloric acid and stirred at reflux for 19 hours. The mixture is cooled and evaporated to dryness on a rotary evaporator under water pump vacuum to yield 151.7 parts of a yellow waxy solid product. I.R. and NMR analysis confirm this to be lactone acid product.

50.0 parts of the crude product are recrystallised from petroleum ether to yield 20.7 parts of white solid, melting point 77°-78° C.

Theory % C=63.16, % H=8.77.
Found % C=63.15, % H=9.09.

EXAMPLE 7

60.0 parts of polymeric ester residue from Example 5 (remaining after distillation of lactone ester intermediate) are mixed with 480 parts of 18% hydrochloric acid and the mixture stirred at reflux for 16 hours. The mixture is cooled and evaporated to dryness to yield 51.0 parts of viscous liquid product. Infra red and NMR analysis are consistent with a polymeric acid product.

EXAMPLE 8

195.0 parts of n-octanol are heated with stirring to 150° C. and a mixture of 43.2 parts of dimethyl maleate and 7.5 parts di-t-butyl peroxide added dropwise over 6 hours at 140°-150° C. Excess starting materials are removed by distillation up to 135° C. under a vacuum of 0.26 mbar to yield 60.0 parts of ester intermediate. 600 mls of 18% hydrochloric acid are added and the mixture stirred at reflux for 16 hours. The mixture is cooled and evaporated to dryness to yield 50.5 parts of brown viscous oil. I.R. and NMR analysis are consistent with a mixture of lactone acid and poly acid in approximately 1:1.5 mole ratio. Weight average molecular weight (Mw) of the product by GPC is 655.

EXAMPLE 9

146.0 parts of n-octanol are heated with stirring to 150° C. and a mixture of 32.3 parts of dimethyl maleate and 5.6 parts di-t-butyl peroxide added dropwise over 6 hours at 140°-150° C. The mixture is then heated for a further 3 hours at 150° C. Excess starting materials are removed by distillation up to 135° C. under a vacuum of 0.065 mbar to yield 40.0 parts of ester intermediate. A solution of 20.0 parts of sodium hydroxide in 200 parts of water is added and the mixture stirred at reflux for 14 hours. The mixture is cooled and extracted with ether to remove unreacted starting materials. 265.0 parts of aqueous solution remain, containing 16% by weight of product as sodium salt. I.R. and NMR analysis are consistent with a mixture of hydroxy di-acid and poly-acid as sodium salts.

EXAMPLE 10

186.0 parts of n-dodecanol are heated with stirring to 150° C. and a mixture of 14.4 parts of dimethyl maleate and 2.5 parts di-t-butyl peroxide added dropwise over 5 and half hours at 150° C. The mixture is then heated for a further 3 hours at 150° C. Excess starting materials are removed by distillation up to 95° C. under a vacuum of 0.4 mbar. Intermediate lactone ester is then distilled at 180°-85° C. under a vacuum of 0.13 mbar to give 21.4 parts of product.

The above ester is mixed with 50.0 parts of 18% hydrochloric acid and stirred at reflux for 16 hours. The mixture is cooled and evaporated to dryness to give 18.4 parts of crude lactone acid product. A sample recrystallised from petroleum ether gives a white solid, melting point 81°-84° C.

Theory % C=68.08, % H=9.72.
Found % C=67.97, % H=9.83.

EXAMPLE 11

78.0 parts of n-octanol and 94.8 parts of n-decanol are mixed and heated with stirring to 150° C. A mixture of 43.2 parts of dimethyl maleate and 7.5 parts di-t-butyl peroxide is then added dropwise over 6 hours at 140°-150° C. Excess starting materials are removed by distillation up to 130° C. under a vacuum of 0.26 mbar to yield 70.0 parts of ester intermediate. A solution of 21.9 parts of sodium hydroxide in 500 parts of water is added and the mixture stirred at reflux for 12 hours. The mixture is cooled and extracted with ether to remove unreacted starting material. 605.0 parts of yellow aqueous solution remain, containing 12% by weight of product as sodium salt. I.R. and NMR analysis are consistent with a mixture of hydroxy di-acid and poly acid as sodium salt.

EXAMPLE 12

192.0 parts of a mixture of linear $C_9$-$C_{11}$alcohols sold under the trade name LINEVOL 911 are heated with stirring to 150° C. and a mixture of 43.2 parts dimethyl maleate and 7.5 parts di-t-butyl peroxide is added dropwise over 6 hours at 140°-150° C. The mixture is then heated for a further 3 hours at 150° C. Excess starting materials are removed by distillation up to 130° C. under a vacuum of 0.26 mbar to yield 75.0 parts of ester intermediate. A solution of 21.8 parts of sodium hydroxide in 500 parts of water is added and the mixture stirred at reflux for 12 hours. The mixture is cooled and extracted with ether to remove unreacted started material. 592.0 parts of yellow aqueous solution remain, containing 12.6% by weight of product as sodium salt. I.R. and NMR analysis are consistent with a mixture of hydroxy di-acid and poly-acid as sodium salts.

EXAMPLE 13

57.4 parts of diethylene glycol mono n-decyl ether are heated with stirring to 150° C. and a mixture of 8.4 parts dimethyl maleate and 1.5 parts di-t-butyl peroxide is added dropwise over 6 hours at 140°-150° C. The mixture is then heated for a further 3 hours at 160°-170° C. Excess starting materials are removed by distillation up to 180° C. under a vacuum of 0.4 mbar to yield 22.9 parts of ester intermediate. A solution of 5.1 parts of sodium hydroxide in 75 parts of water is added and the mixture stirred at reflux for 12 hours. The mixture is cooled and extracted with ether to remove unreacted starting material. 97.6 parts of aqueous solution remain, containing 18% by weight of product as sodium salt. I.R. and NMR analysis are consistent with a mixture of hydroxy di-acid and poly-acid as sodium salts.

EXAMPLE 14

38.8 parts of ethylene glycol mono n-decyl ether are heated with stirring to 150° C. and a mixture of 6.9 parts dimethyl maleate and 1.2 parts di-t-butyl peroxide is added dropwise over 6 hours at 150° C. The mixture is then heated for a further 3 hours at 150° C. Excess starting materials are removed by distillation up to 150° C. under a vacuum of 0.65 mbar to yield 17.4 parts of ester intermediate. A solution of 4.4 parts of sodium hydroxide in 75 parts of water is added and the mixture stirred at reflux for 12 hours. The mixture is cooled and extracted with ether to remove unreacted starting material. 92.0 parts of aqueous solution remain, containing 14% by weight of product as sodium salt. I.R. and NMR analysis are consistent with a mixture of hydroxy di-acid and poly-acid as sodium salts.

EXAMPLE 15

261.0 parts of 1,10-decanediol are heated with stirring to 150° C. and a mixture of 43.2 parts dimethyl maleate and 7.5 parts di-t-butyl peroxide is added dropwise over 6 hours at 150° C. The mixture is then heated for a further 3 hours at 150° C. Unreacted starting materials are removed by distillation up to 125° C. under a vacuum of 0.08 mbar to yield 86.8 parts of ester intermediate. A solution of 24.3 parts of sodium hydroxide in 550 parts of water is added and the mixture stirred at reflux for 12 hours. The mixture is cooled and filtered to remove unreacted starting material. 661.0 parts of aqueous solution remain, containing 14% by weight of product as sodium salt. I.R. and NMR analysis are consistent with a mixture of hydroxy di-acid and poly-acid as sodium salts.

EXAMPLE 16

195.0 parts of n-octanol are heated with stirring to 150° C. and a mixture of 29.4 parts maleic anhydride and 7.5 parts di-t-butyl peroxide is added dropwise over 6 hours at 140°-150° C. Unreacted starting materials are removed by distillation up to 95° C. under a vacuum of 0.08 mbar to yield 88.0 parts of ester intermediate.

44.0 parts of the above intermediate are mixed with 8.8 parts of sodium hydroxide and 250 parts of water and the mixture stirred at reflux for 12 hours. The mixture is cooled and filtered to remove unreacted starting material. 240.0 parts of aqueous solution remain, containing 12% by weight of product as sodium salt. I.R. and NMR analysis are consistent with a mixture of hydroxy di-acid and poly-acid as sodium salts.

EXAMPLE 17

237.0 parts of n-decanol are heated with stirring to 150° C. and a mixture of 36.0 parts dimethyl maleate, 5.0 parts of ethyl acrylate and 7.5 parts di-t-butyl peroxide is added dropwise over 6 hours at 150° C. Excess starting materials are removed by distillation up to 150° C. under a vacuum of 1.04 mbar to yield 68.7 parts of ester intermediate. 500 parts of 18% hydrochloric acid are then added and the mixture stirred at reflux for 16 hours. The mixture is cooled and evaporated to dryness to give 58.0 parts of waxy solid product. I.R. and NMR analysis are consistent with a mixture of lactone acid and poly acid.

EXAMPLE 18

237.0 parts of n-decanol are heated with stirring to 150° C. and a mixture of 30.0 parts ethyl acrylate and 7.5 parts di-t-butyl peroxide is added dropwise over 6 hours at 150° C. The mixture is heated for a further 3 hours at 150° C. Excess starting materials are removed by distillation up to 100° C. under a vacuum of 0.05 mbar to yield 55.0 parts of intermediate. 600 parts of 18% hydrochloric acid are then added and the mixture stirred at reflux for 16 hours. The mixture is cooled and evaporated to dryness to give 48.0 parts of viscous product. I.R. and NMR analysis are consistent with a mixture of lactone acid and poly acid.

EXAMPLES 19-32

Corrosion inhibitor activity is evaluated in the following way by the Aerated Solution bottle Test using three corrosive test waters, A, B and C. Analysis of these waters is shown in Table 1.

TABLE 1

| | A | B | C |
|---|---|---|---|
| pH | 7.2 | 7.6 | 8.0 |
| Phenol Alkalinity (ppm as $CaCO_3$) | 0 | 0 | 0 |
| Total Alkalinity (ppm as $CaCO_3$) | 20 | 204 | 210 |
| Total hardness (ppm as $CaCO_3$) | 110 | 216 | 580 |
| Calcium hardness (ppm as $CaCO_3$) | 75 | 150 | 500 |
| Chloride (ppm as $Cl^-$) | 5 | 36 | 300 |
| Sulphate (ppm as $SO_4^{2-}$) | 110 | 40 | 40 |

TABLE 1-continued

| | A | B | C |
|---|---|---|---|
| Ryznar index at 40° C. | 9.4 | 6.4 | 5.2 |

2 mild steel coupons, 5 cms×2.5 cms are scrubbed with pumice, immersed for one minute in hydrochloric acid and then rinsed, dried and weighed.

The desired proportion of test compound is dissolved in 200 ml of each corrosive water. Two steel coupons are suspended in the solution, and the whole is stored in a closed bottle in a thermostat at 40° C. During the storage period, air is passed into the solution at 500 ml/minute, the passage of the air being screened from the steel coupons; any water losses by evaporation are replaced with distilled water.

After 64 hours, the steel coupons are removed, scrubbed without pumice, immersed for one minute in hydrochloric acid inhibited with 1% by weight of hexamine and then rinsed, dried and reweighed. A certain loss in weight will have occurred. A blank test i.e. immersion of mild steel specimens in the test water in the absence of any potential corrosion inhibitor, is carried out with each series of tests. The corrosion rates are calculated in milligrams of weight loss/square decimeter/day (m.d.d.).

The corrosion rate results obtained for each test compound are shown in Table 2.

TABLE 2

| Example No. | Product of Example | Additive conc. (ppm) | Corrosion rate (m.d.d.) water A | water B | water C |
|---|---|---|---|---|---|
| 19 | 1 | 200 | 2.3 | 4.6 | 11.6 |
| 20 | 2 | " | 6.2 | 54.3 | 13.7 |
| 21 | 3 | " | 5.8 | 5.7 | 9.2 |
| 22 | 4 | " | 3.0 | 2.3 | 2.6 |
| 23 | 7 | " | 7.4 | 2.8 | 33.9 |
| 24 | 8 | " | 7.5 | 4.8 | 19.6 |
| 25 | 9 | " | 6.9 | 37.0 | 17.9 |
| 26 | 11 | " | 5.6 | 3.5 | 9.1 |
| 27 | 12 | " | 12.9 | 4.6 | 9.1 |
| 28 | 13 | " | 4.1 | 5.9 | 8.6 |
| 29 | 14 | " | 2.5 | 6.0 | 18.4 |
| 30 | 15 | " | 5.1 | 5.5 | 42.9 |
| 31 | 16 | " | 8.6 | 11.2 | 35.4 |
| 32 | 17 | " | 7.7 | 2.1 | 24.6 |
| | Blank | — | 56.0 | 57.8 | 45.7 |

From the results it can be seen that products show activity as corrosion inhibitors in all the test waters particularly at lower calcium levels.

What is claimed is:

1. A composition, in contact with a corrodible metal surface, which composition comprises:

a) an aqueous-based or oil-based system; and b) as inhibitor for protecting the metal surface against corrosion, an effective amount of at least one compound having the formula II:

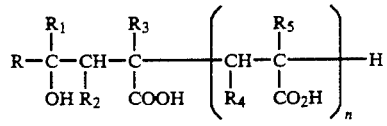

II as well as salts or partial esters thereof wherein:

n is 0 or an integer ranging from 1 to 20,

R is a straight or branched chain $C_4$–$C_{30}$alkyl group, a straight or branched chain $C_4$–$C_{30}$alkyl group interrupted by one, two or three oxygen atoms or substituted by one, two or three hydroxy groups, a $C_5$–$C_{12}$cycloalkyl group, a $C_6$–$C_{10}$aryl group, $C_6$–$C_{10}$aryl group substituted by one, two or three $C_1$–$C_{12}$alkyl groups, a $C_7$–$C_{13}$aralkyl group or a $C_7$–$C_{13}$aralkyl group which is substituted by a hydroxyl group;

$R_1$ is H or a straight- or branched chain $C_1$–$C_4$alkyl group;

$R_2$ is H, a straight or branched chain $C_1$–$C_4$alkyl group or $CO_2H$;

$R_3$ is H, a straight or branched chain $C_1$–$C_4$alkyl group, —$CH_2CO_2H$ or —$CH_2CH_2CO_2H$;

$R_4$ is H, a straight or branched chain $C_1$–$C_4$alkyl or $CO_2H$;

$R_5$ is H, a straight or branched chain $C_1$–$C_4$alkyl group, $CH_2CO_2H$ or $CH_2CH_2CO_2H$; with the following proviso when n is an integer from 1 to 20 at least one group $R_4$ is $CO_2H$.

2. A composition according to claim 1, wherein the corrodable metal surface is a ferrous metal surface.

3. A composition according to claim 1, wherein n is an integer from 1 to 10.

4. A composition according to claim 3, wherein n is an integer from 1 to 5.

5. A composition according to claim 1, wherein R is $C_4$–$C_{20}$alkyl; $R_1$ is H; $R_2$ is $CO_2H$; $R_3$ is H; $R_4$ is $CO_2H$; and $R_5$ is H.

6. A composition according to claim 5, wherein R is a straight-chain $C_6$–$C_{15}$alkyl group or a straight-chain $C_6$–$C_{15}$alkyl group interrupted by one or two oxygen atoms.

7. A composition according to claim 1, wherein the amount of the compound of formula I, or a mixture thereof, ranges from 0.0001 to 5% by weight, based on the total weight of the aqueous- or oil-based system.

8. A composition according to claim 1, wherein the system is oil-based and the system also contains one or more antioxidants metal deactivators, further corrosion or rust inhibitors, viscosity-index improvers, pour point depressants, dispersants/surfactants or anti-wear additives.

9. A composition according to claim 1, wherein the system is completely aqueous and the system also contains one or more further corrosion inhibitors, dispersing and/or threshold agents, precipitating agents, oxygen scavengers, sequestering agents; antifoaming agents; and biocides.

10. A composition according to claim 1, wherein the system is partly aqueous and the system also contains one or more further corrosion inhibitors or extreme-pressure additives.

11. Method of protecting a metal surface against corrosion, which comprises the contact of a compound of formula I according to claim 1 as an inhibitor with said metal surface.

* * * * *